United States Patent [19]

Bodet et al.

[11] Patent Number: 5,060,800

[45] Date of Patent: Oct. 29, 1991

[54] TIGHT CONTAINER PARTICULARLY FOR FOOD PRODUCTS

[75] Inventors: Jean A. Bodet, Saint Forget les Sablons; Pierre-Denis Kuhlmann, Neuilly sur Seine, both of France

[73] Assignee: Societe Parisienne d'Impression et de Cartonnage (SPIC), Colombes, France

[21] Appl. No.: 572,334

[22] Filed: Aug. 24, 1990

Related U.S. Application Data

[63] Continuation of Ser. No. 204,425, Jul. 22, 1988, abandoned.

[30] Foreign Application Priority Data

Sep. 23, 1986 [FR] France ..... 86 13321

[51] Int. Cl.[5] ..... B65D 21/00

[52] U.S. Cl. ..... 206/512; 206/503; 206/509; 206/557; 206/562; 206/524.8; 229/104; 229/918; 493/85; 493/110; 264/516; 156/285

[58] Field of Search ..... 206/471, 503, 518, 519, 206/524.8, 557, 562, 564, 567, 509, 511, 512; 220/23.83; 229/104, 918; 493/85, 110, 902, 906; 264/512, 516; 156/285

[56] References Cited

U.S. PATENT DOCUMENTS

| | | | |
|---|---|---|---|
| 2,063,328 | 12/1936 | Morcom | 248/152 |
| 2,071,949 | 2/1937 | Reich | 229/104 |
| 2,749,245 | 6/1956 | Peters . | |
| 2,858,224 | 10/1958 | Darrah | 206/602 |
| 2,979,250 | 4/1961 | Hobbs | 229/104 |
| 3,183,800 | 5/1965 | Farrell et al. | 206/557 |
| 3,197,026 | 7/1965 | Gabryel | 206/471 |
| 3,349,985 | 10/1967 | Salway | 206/521 |
| 3,409,445 | 11/1968 | Hall | 493/110 |
| 3,499,595 | 3/1970 | Brooks | 229/104 |
| 3,759,413 | 9/1973 | Ardito . | |
| 3,953,273 | 4/1976 | Faller | 264/512 |
| 3,983,999 | 10/1976 | Morton | 206/602 |
| 4,047,358 | 9/1977 | Heffernan et al. | 264/516 |
| 4,314,650 | 2/1982 | Cillario | 206/562 |
| 4,368,941 | 1/1987 | Watson | 229/104 |
| 4,529,464 | 7/1985 | Jones | 156/285 |
| 4,555,381 | 11/1985 | Chazal et al. | 264/516 |
| 4,821,884 | 4/1989 | Griffen et al. | 206/557 |

FOREIGN PATENT DOCUMENTS

| | | | |
|---|---|---|---|
| 2576881 | 8/1986 | France . | |
| 474425 | 8/1969 | Switzerland | 229/23 R |

*Primary Examiner*—David T. Fidei
*Attorney, Agent, or Firm*—Cushman, Darby & Cushman

[57] ABSTRACT

A container comprises a man-made material film which is shaped to define at least one sealed compartment, a plane top around the compartment or compartments and continuous external walls which surround the compartment or compartments. These walls have a height at least equal to that of the compartment or compartments. The man-made material film is backed by at least one bonded-on layer of cardboard over substantially all the inside surface of each wall and of the top. The man-made material film is in a single piece which constitutes an uninterrupted outside wall all around the container and a plane top and which forms at least one compartment inside the volume determined by the outside wall of the container and by the top. The cardboard part constitutes in a single piece a top with at least one opening in it and side walls with adjacent edges.

15 Claims, 5 Drawing Sheets

TIGHT CONTAINER PARTICULARLY FOR FOOD PRODUCTS

This is a continuation of application Ser. No. 07/204,425, filed Jul. 22, 1988, which was abandoned upon the filing hereof.

BACKGROUND OF THE INVENTION

There are already known containers usually called trays and intended to receive liquid, free-flowing or semi-solid products, as is often the case with food products: yogurt, butter, cooked dishes, etc. Consequently, these containers must be sealed. Also, they must be rugged in order to withstand stresses associated with transportation and storage and of an esthetic and attractive appearance since they are designed to present the products to the public.

It is difficult to reconcile these requirements since cardboard cannot provide a seal, being hydrophilic, although this material is that best suited to obtain a high quality esthetic appearance. Man-made materials are easy to use and provide a seal, but are of mediocre appearance because they are difficult to print.

Thought has therefore been given to combining cardboard and a man-made material to combine the advantages specific to each of these materials, but this leads to certain problems, notably associated with fitting lids intended to enclose the packaged product without risk of leakage.

One solution to this problem is described in the document FR-A-2.480.708 which teaches the creation of a single-piece frame to constitute a plane and regular surface to which a lid can be applied and fixed without serious risk of leakage.

Because of changing trends in consumption, customers are ever more demanding and containers must be capable of ever better performance to withstand, without damage, extremely stressful treatment such as freezing, deep-freezing, reheating, cooking the food in the packaging, long-term conservation of taste and smell, protection against oxidation and aging, barrier-effect walls, vacuum packaging, controlled atmosphere packaging, etc.

At this time there is virtually no packaging design based on a principle enabling implementation in different forms according to customer requirements. It will be understood, for example, that it is unrealistic to expect to use a tub for vacuum packaging without any deformation of its walls.

These changing requirements have the effect of ruling out, for certain applications, containers with walls using cardboard on the outside since moisture attack arises not only from the inside but also from the outside (storage in a humid atmosphere, for example).

Until now the cardboard has essentially been protected against moisture or grease inside it by providing a film of man-made material on the inside of the cardboard and not on the outside. This is the case with the container described in the previously mentioned document FR-A-2.480.708 and that described in the document FR-A-2.576.881.

SUMMARY OF THE INVENTION

The present invention teaches an entirely new solution by virtue of which various embodiments of container may be made from the same general solution combining the needs for internal and external sealing.

To this end, one object of the invention is a container characterized in that it is constituted by a man-made material film which is shaped to define at least one sealed compartment, a plane top around the compartment or compartments and continuous external walls which surround said compartment or compartments and which have a height at least equal to that of the latter, the man-made material film being backed by at least one layer of bonded-on cardboard over substantially all the inside surface of each wall and the top.

Another object of the invention is a method of producing a container of the above type characterized in that a printed, scored and cut-out cardboard blank is produced, stored with other like blanks, taken from stock, formed to shape by folding its peripheral parts to constitute a cardboard part having its printed side on the outside and comprising a top area with at least one opening cut out from it and side walls with adjacent edges and placed in a heat-forming mold, a man-made material film is heat-formed so as to adhere to substantially all of the printed surface of the cardboard part covering in a sealed way all gaps at the adjacent edges of the walls and forming as many sealed compartments as there are openings in the top, said opening or openings having to be aligned with at least one cell of the mold, and the container consisting of the assembled cardboard part and the man-made material film is removed from the mold.

BRIEF DESCRIPTION OF THE DRAWING

The invention will be better understood from the detailed description given hereinafter with reference to the drawings. Of course, the description and the drawings are given by way of non-limiting example only.

DETAILED DESCRIPTION OF THE PRESENTLY PREFERRED EXEMPLARY EMBODIMENTS

Figure 1:
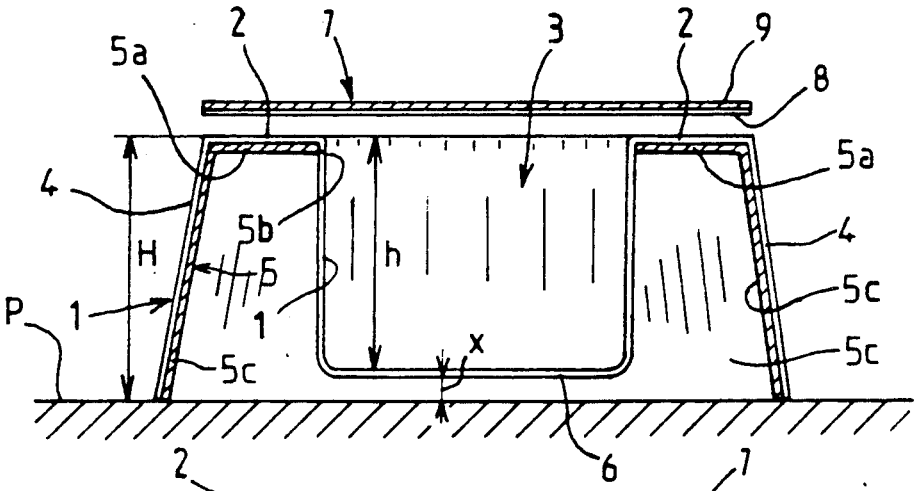
FIG. 1 is a schematic view in cross-section of a container in accordance with the invention designed to receive a lid shown above it.

Referring to FIG. 1, a container in accordance with the invention comprises a film 1 of man-made material which constitutes, in one piece, a top 2, a compartment 3 and side walls 4 determining the height of the container and forming a sealed continuous surround, in the manner of a bottomless box.

The man-made material film 1 is backed by a layer of cardboard 5, in this instance in a single piece, including under the top 2 a panel 5*a* through which passes a central opening 5*b* which leads into the volume determined by the side walls 4, and also as many panels 5*c* as there are walls 4.

The man-made material film 1 extends through the opening 5*b* and the compartment 3 has a height h substantially equal to, but slightly less than, that H of the side walls 4–5 in order to leave a clearance x between the bottom 6 of the compartment 5 and a plane p on which the container may rest.

After filling the compartment 3, for example by means of automatic weighing or metering packaging machines, a lid 7 is applied to the frame 2–5 and fixed to it by any known means: adhesive-bonding, heat-welding, ultrasonic welding, etc.

It will be seen that with a container of this kind the functions of containing, protecting, stabilizing and presentation are dissociated from one another. It is therefore possible to treat the "useful" part (the compartment 3) differently to the "facade" 30 (the combination of walls 4–5). The cardboard part 5 is printed on its outside surface bonded to the film 1, which is transparent to show the printing on the cardboard.

Note that the cardboard panels 5*c* are simply adjacent as no overlapping flaps are provided, in contrast to a currently well-known method. However, the container is sealed by virtue of the man-made material film 1 which is continuous and which covers externally the discontinuities at the corners of the cardboard part. The container is therefore resistant to external attack and reaches the point of sale in perfect condition, despite transportation, intermediate storage and handling. The cardboard contributes to the ruggedness, rigidity and strength of the container, of course, but it is placed under the sealed layer and its decoration is therefore protected.

It should be noted, however, that the "useful part" of the container, namely the compartment 3, is itself sealed and therefore perfectly suited to fulfilling its role which is to protect the packaged product.

The cardboard part 5 is advantageously formed in a single piece by cutting and scoring a single cardboard blank. Peripheral score lines enable the walls 5*c* to be folded up. The blank may therefore receive any printing in any colors by virtue of the well-known hydrophilic nature of cardboard, which is also strong and has the necessary rigidity to make the container resistant to crushing, impact and other stresses inherent to handling the containers. This embodiment also leaves discontinuities at the corners of the container by virtue of the fact that the adjacent panels 5*c* are simply adjacent, without any overlapping members.

The fixing of the film 1, fundamentally necessary for "fixing" the compartment 3 onto the cardboard part 5, creates on the outside of the container a continuous film (even at the discontinuities in the cardboard part 5) the appearance of which is particularly esthetic and attractive. The presence of man-made material on the outside surface of the frame 1 makes it possible to attach the lid 7 by heat-welding, the latter comprising to this end a film of heat-weldable man-made material 8. In this instance, a sheet 9 of cardboard is also provided for receiving printing by way of useful information or promotional or decorative material.

Figure 2:
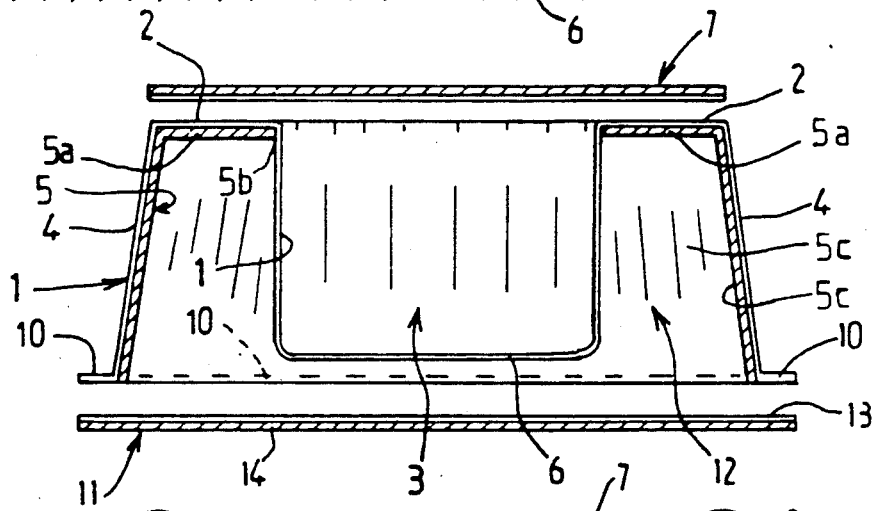
FIG. 2 is schematic view in cross-section of a container in accordance with the invention designed to receive two lids shown one above and the other below it.

Referring now to FIG. 2, there is seen a container analogous to that of FIG. 1 but incorporating a variation whereby the film 1 is cut in such a way as to be slightly longer and slightly wider than would be strictly necessary for its alignment with the bottom of the cardboard panels 5*c*. The film 4 is heat-formed so as to be upstanding along all its edges to constitute a continuous peripheral rim 10 at the bottom of the side walls 4–5. A second lid 11 may therefore be heat-welded to the rim 10 in order to close off in a sealed way all of the volume 12 between the bottom of the frame 1, the inside of the side walls 4–5 and the bottom of the compartment 3. Thus the air in this space is trapped and constitutes thermal insulation whereby the container in accordance with the invention may be used for temperature-sensitive products: desserts, ice creams, sorbets and the like. The second lid may also comprise a heat-weldable film 13 and a cardboard sheet 14, the latter in this instance having a different function than that 9 of the lid 7: it makes the container as a whole rigid as it holds the walls 4–5 and prevents them bending towards the center of the container, and it also contributes to thermal insulation by separating the air trapped in the volume 12 from the surrounding atmosphere. Through the rigidity that it confers, the second lid 11 is therefore beneficial even if the insulative qualities of the container are not significant for any particular product.

Figure 3:
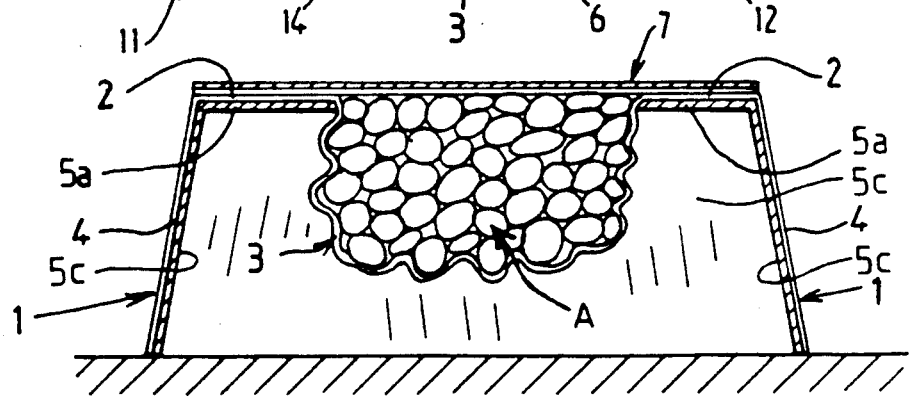
FIG. 3 is a schematic view in cross-section of a container in accordance with the invention comprising a vacuum-packed compartment containing a product.

FIG. 3 illustrates the benefit of separating the packaging function proper from the presentation function proper. In this instance the container is used for vacuum-packed products. For this reason the film 1 is of the quality known in itself to lend itself to deformation due to the reduced pressure inside the compartment 3. When filled, evacuated and covered with its lid the container is in the situation shown in FIG. 3: the film 1 is pulled down vigorously onto the mass of the packaged product A and the combination assumes a shape which is both unattractive and impractical. At this time, this solution is used virtually only with sachets which are then placed in cardboard boxes so that the product offered for sale is presentable and the containers can be stacked and stored conveniently. It will be seen that the container in accordance with the invention is more practical, more rational and more economical. It makes possible new packaging and presentation solutions.

Figure 4:
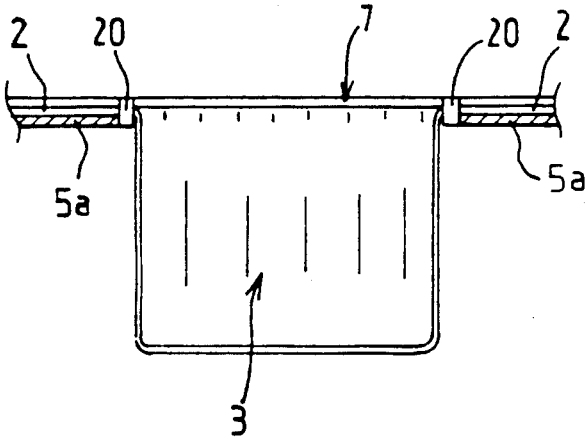
FIG. 4 shows an embodiment of the invention in which lines of weakness are provided to enable the container to be separated after its purchase in a store.

FIG. 4 shows an embodiment of the invention is which lines of weakness are provided, for example aligned perforations 20 placed at locations carefully chosen to enable the container to be split up. This may be useful for separating the man-made material compartment 3 from the cardboard part or for breaking up a container comprising several independent compartments. It is possible to produce a container having a top featuring a multiple frame, in the manner of a grid, and a man-made material film forming as many compartments as there are "cells" between the strips of cardboard. It is then beneficial to be able to split up the container, each compartment of which represents one portion. If the products packaged in a container of this kind must be kept cold, the container is placed in a refrigerator and the portions are removed one by one by cutting the frame and the lid along the perforations 20.

Figure 5:
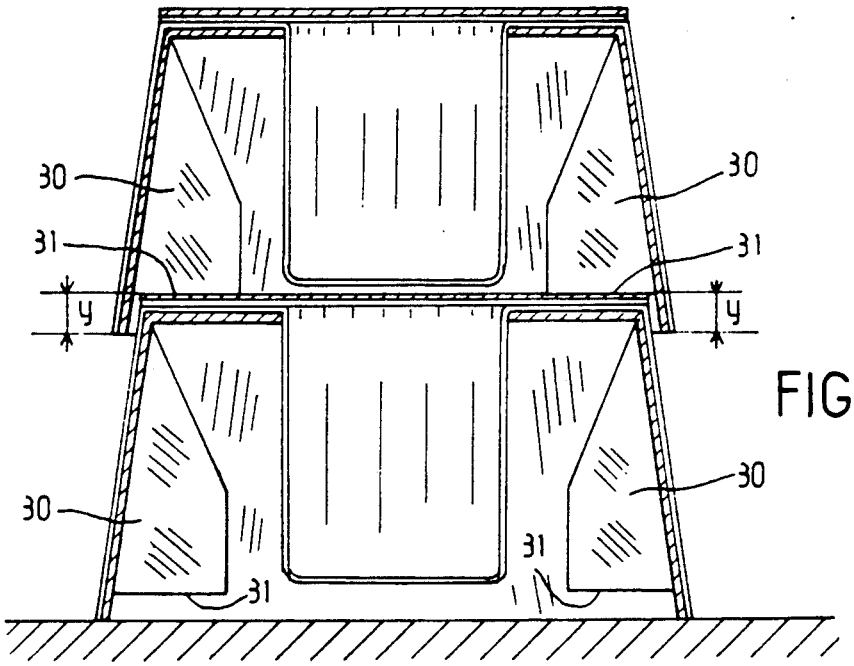
FIG. 5 is a schematic view in cross-section showing two identical containers in accordance with the invention provided with bases and stacked one on the other.

As is known, it is advantageous to be able to stack several identical containers without them jamming one inside the other. To this end, the perimeter of the container at the level of the lid 7 is made smaller than the perimeter at the level of the bottom of the side walls 4–5. As seen in the drawing, the container then has a trapezium shape in vertical cross-section. This geometry is sufficient on its own to enable an upper container to cap the top of a lower container as seen in FIG. 5, but it is not satisfactory with containers in accordance with the invention as these would rest on the lids of the lower containers through the compartment 3 which could be too flexible or too fragile to constitute a sensible base. This is why the invention further provides feet 30 at some corners at least of each container so that they come into contact with a lower container before the compartment 5 reaches the latter. The feet 30 are of a size such that their lower part or base 31 is located slightly short of the lower edges of the walls 4–5. Thus the upper container can slightly cap the lower container to ensure lateral stability and the compartment 3 is situated slightly above the lower container, that is to say protected against blows, pressure and friction.

The feet 30 may be obtained in the manner now to be described with reference to FIGS. 5, 6 and 7.

The cardboard walls **5*c* are joined not only to the top 2 but also to flaps which join them in pairs at each corner of the container (in this instance there are four of them as the container is four-sided). Score lines 32, 33 and 34 define two flaps 35 and 36 and are situated so that when the walls 5*c* are folded relative to the top 2 the flaps 35 and 36 are folded one against the other, towards the inside of the container rather than towards the outside, as seen in FIG. 6**.

The flaps 35 and 36 are delimited by edges 37 and 38 perpendicular to the lines 32 and 34 and separated from the edges of the walls 2 by a distance y equal to the nesting distance that is required on stacking two containers (FIG. 5).

The flaps 35 and 36 are also cut into on two convergent lines which form a kind of notch 39; after the flaps 35 and 36 are folded one against the other these two lines become adjacent and together constitute the base 31 of the feet 30. When the panels **5*c* are folded, the flaps 35 and 36 are folded one against the other in a symmetrical way so that a natural equilibrium results when the flaps extend substantially along the bisector of the angle between the two panels 5*c*. In this instance the container is four-sided and the walls are perpendicular, so that the feet 30 are at an angle of substantially 45° to the adjacent panels 5*c*. These divisions result in excellent equilibrium of the stacked containers and excellent protection of the compartments 3**.

Although the flaps 35 and 36 are joined together and therefore join two adjacent panels, they do not in any way seal the cardboard part (which is hydrophilic in any case) and here again a discontinuity remains in the cardboard part of the walls. This is seen particularly clearly in FIG. 6. Consequently, the two neighbouring panels **5*c* are still regarded as "adjacent", by virtue of the discontinuity of the walls. Even assuming that the flaps 35 and 36** are bonded together by means of a sealed adhesive, this would be of little significance as it would result in a complication of manufacture and increased production costs, and have virtually no effect on the esthetic appearance of the finished container.

An equivalent of the invention would therefore not be obtained by covering the FIG. 7 blank with a man-made material film and subsequently forming the assembly to shape (the film present on the flaps 35 and 36 would enable them to be joined by hot bonding, for example) but apart from the only partial securing of a doubtful seal, the container would have discontinuous outside walls constituting fragile areas of mediocre appearance at the corners.

Figure 6:
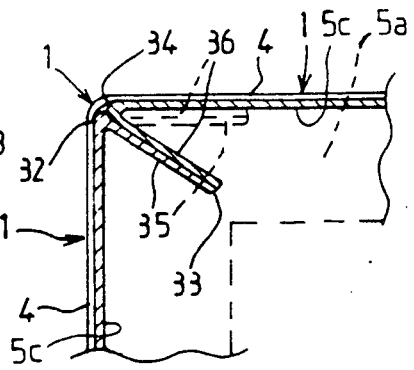
FIG. 6 is a partial schematic view showing the structure of a container in accordance with the invention as seen at one corner which incorporates a base enabling two identical containers to be stacked as shown in FIG. 5.

FIG. 6 shows particularly well how the continuous film 1 simultaneously provides external sealing of the walls of the container and reinforcement of the corners by covering the discontinuities in the cardboard part 5. Note that this quality is independent of the position of the flaps 35–36 within the walls **5*c* and of the presence or absence of a second man-made material film on the inside surface of the cardboard part 5 (see FIG. 13** and corresponding description).

Figure 7:
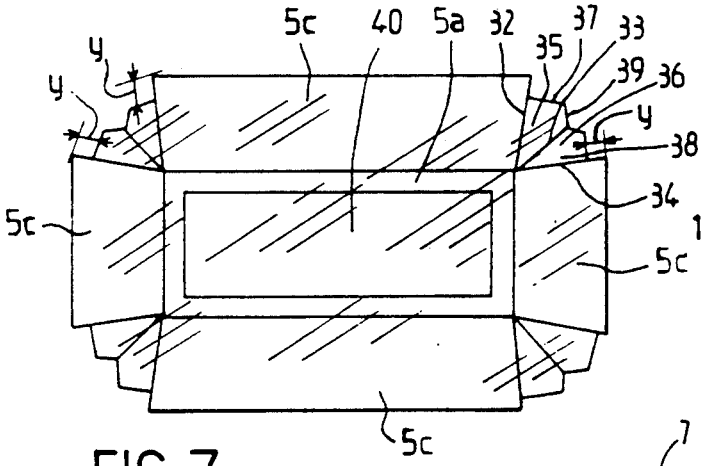
FIG. 7 is plan view of a cut and scored cardboard blank in accordance with the invention for producing a container of the type shown in FIG. 8 after bending and heat-forming a film of man-made material.
Figure 8:
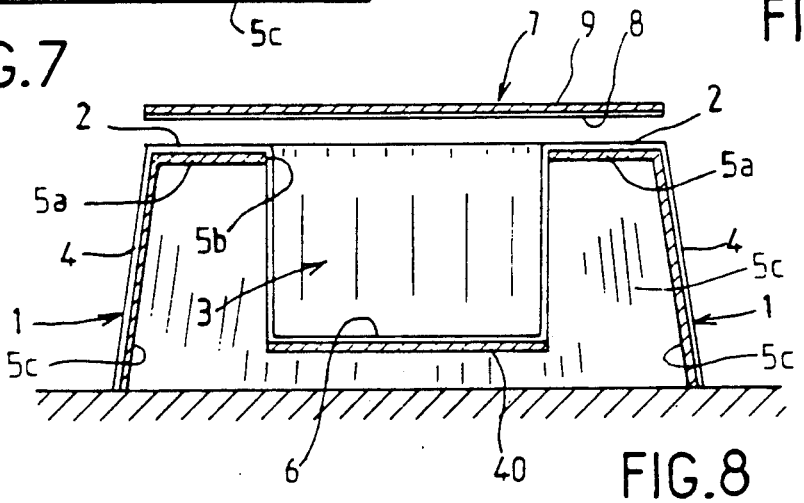
FIG. 8 is a schematic view in cross-section of a container in accordance with the invention in a particular embodiment providing a cardboard part situated under a man-made material compartment and produced from the blank in FIG. 7.

Referring to FIG. 7, it is seen that to provide the opening **5*b* in the cardboard part 5, a central area 40 is created. In FIGS. 1 through 6 it is assumed that the central area 40 is removed. FIG. 8 shows one way of making use of this area 40. When the cardboard blank is cut out, the area 40 is left in place, by providing uncut bridges between it and its surround, for example, in the way known in itself. Subsequently, the area 40 is detached and placed over the location at which the compartment 3 is to be located. When the film 1 is applied, the bottom 6 of the compartment 3 comes into contact with the area 40 to which it is bonded. After fixing the cardboard part 5 and the man-made material film 1, the area 40 is therefore imprisoned under the bottom 6 of the compartment 3, as seen in FIG. 8. This strengthens the compartment 3** which is able to withstand impacts, pressure and friction during handling of the container.

In the case of a container for separate portions, provision may be made for placing a central area under the bottom of each compartment 3 in this way.

According to the above description, the central area 40 represents all of the cardboard surface situated inside the frame 5*a*, and as a consequence of this, the compartment 3 is formed entirely from man-made material, except for its bottom 6 when the area 40 is joined to it.

Another solution that may be adopted is to use the central cardboard area 40 to strengthen the man-made material film 1. This reinforcing can be done in two ways one shown in FIGS. 9 and 10, the other in FIGS. 11 and 12.

In the first way of doing this, the central area 40 is separated from the inside edges of the frame 5*a* by score lines 41 and its surface is cut along lines 42 running from the corners of the frame 5*a* and defining four flaps 43, 44, 45 and 46. Given the rectangular shape of the frame 5*a*, the flaps 44 and 46 are triangular whereas the flaps 43 and 45 are trapezium-shaped. When the cardboard blank is folded to shape, the flaps 43 and 46 are folded towards the bottom through angles determined by the shape that the compartment 3 is to have. If the walls of the latter are inclined so that the compartment 3 has the shape of an inverted truncated pyramid, for example, the flaps 43 and 46 will be folded through the angles at the base of these walls. Here there is shown a simple case in which the compartment 3 is of parallelepiped shape so that the flaps 43 through 46 are in planes perpendicular to that of the frame 5*a*.

Figure 10:
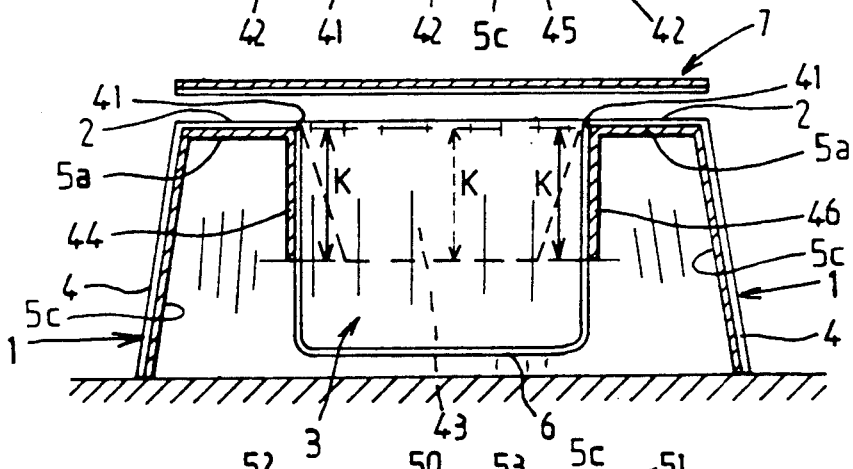
FIG. 10 is a schematic view in cross-section of a container in accordance with the invention in a specific embodiment providing flaps as long as possible inside an opening in the top and produced from the blank of FIG. 9.
Figure 11:
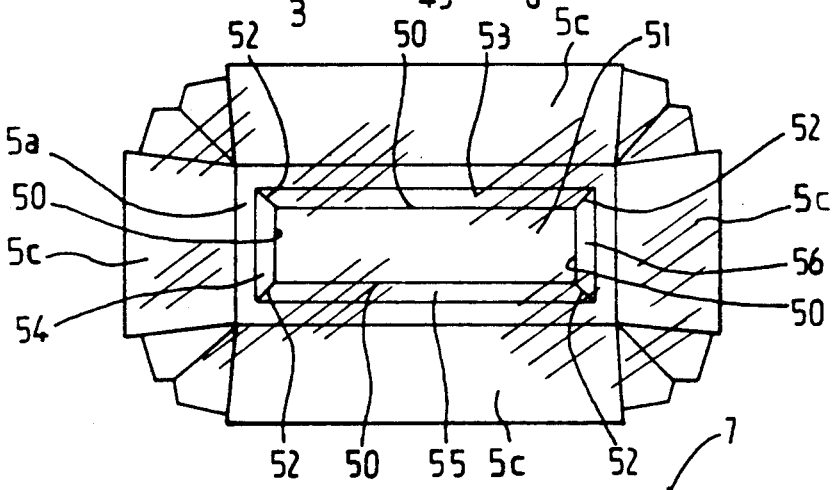
FIG. 11 is a plan view of a cut and scored cardboard blank in accordance with the invention for producing a container of the type shown in FIG. 12 after folding and heat-forming a film of man-made material.

When the film 1 is heat-formed into place it molds itself against the flaps 43 and 46, covering them entirely, and bonds itself to them as shown in FIG. 10. The finished container is therefore extremely strong since the walls of the compartment 3 are stiffened and reinforced by the cardboard flaps 43 through 46.

Note from FIG. 10 that this construction eliminates the sharp corners of the opening 5*b* that is seen in FIGS. 1 through 5 because this opening is obtained by cutting out the frame 5*a* and the area 40.

If the cardboard is thin and rigid these sharp edges may constitute lines of weakness since they tend to split the film 1, especially if the product packaged in the compartment 3 is heavy, since the compartment 3 and its contents are so to speak suspended from the frame 2–5*a*. The presence of the flaps 43 through 46 therefore further strengthen the container.

The height k of the flaps 43 and 45 has the maximum possible value, which is equal to one half the distance between the two opposite sides of the frame 5*a* that are closest together or, which amounts to the same thing, the two opposite sides nearest the opening created for the film 1 when folding the flaps 43–46. The flaps 44 and 46 are the same height k because the lines 42 bisect a right angle. The flaps 43–46 could be cut differently, of course, notably by lines perpendicular to the sides of the frame 5*a*, but this would provide less reinforcing surface. It is therefore beneficial for the flaps 43–46 to have oblique lateral edges terminating at the corners of the opening (or the inside corners of the frame 5*a*).

In the second version, the central area is cut by four lines 50 which close on themselves to determine a central area 51 and by four oblique lines 52 running from the inside corners of the frame 5*a*. The central area 51 has a smaller surface area than that 40 of FIGS. 7–8, but in this instance four flaps 53, 54, 55 and 56 are also provided. This solution is a compromise between the FIG. 7–8 construction and the FIG. 9–10 construction. There is a central part 51 that may be placed under the bottom 6 of the compartment 3, as shown in FIG. 12, and benefiting from the presence of the flaps 53–56 which eliminate the sharp edges of the frame 5*a* as explained hereinabove.

Figure 12:
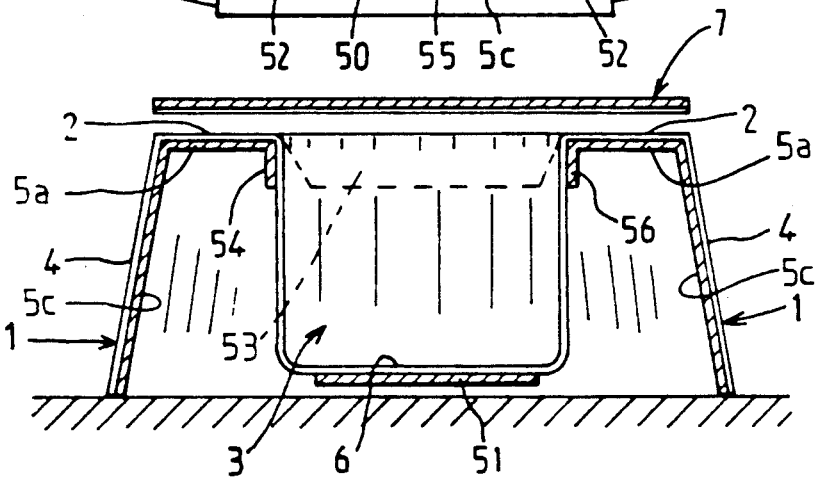
FIG. 12 is a schematic view in cross-section of a container in accordance with the invention in a specific embodiment providing relatively short flaps inside an opening in the top and produced from the blank of FIG. 11.

If the lateral walls of the compartment 3 are perpendicular to the plane of the frame 1, as shown in FIG. 12, it is clear that the bottom 6 has a larger surface area than the part 51. This is acceptable because the bottom 6 is in any event better protected in this way than without any cardboard at all, but this solution is particularly well-suited to the relatively frequent case in which the compartment 3 is required to have the shape of an inverted truncated pyramid. The bottom 6 may then have the same surface area as the part 51 so that the latter covers it entirely and protects it completely.

Figure 13:
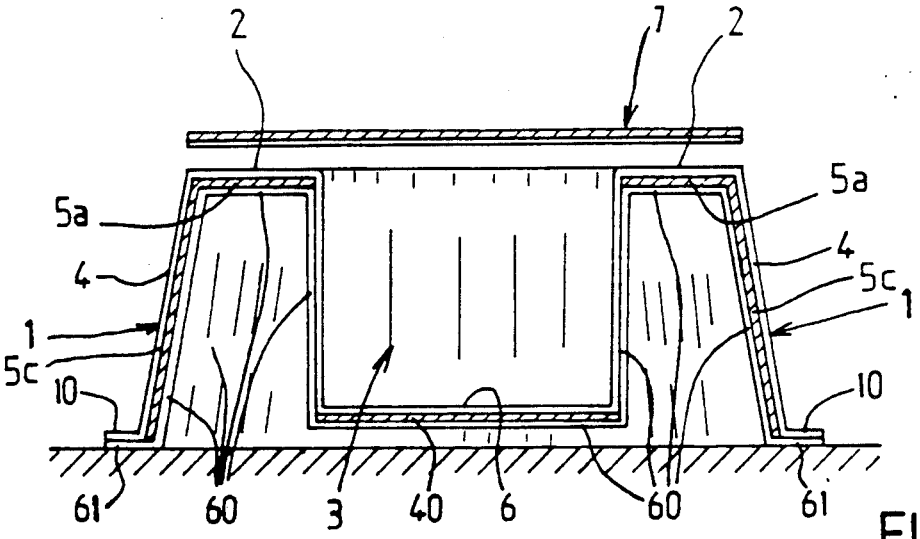
FIG. 13 is a schematic view in cross-section of a container in accordance with the invention and comprising a cardboard part entirely covered with sealed man-made material so as to be capable of being immersed in water, for example.

Referring now to FIG. 13, there is seen an embodiment of the invention in which a second man-made material film 60 is applied to the inside surface of the cardboard panels 5*b*, under the frame 5*a*, against the compartment 3 and under its bottom 6. All the cardboard part 5 of the component is then entirely surrounded with sealed man-made material. It is beneficial to combine this solution with that which provides for the creation of a rim 10 so that a corresponding rim 61 of the film 60 may be welded to it. The lower edge of the cardboard panels 5*b* is then also enclosed.

A container of this type offers particularly high performance since it benefits from all the advantages of cardboard: strength, stiffness, the ability to be printed; and also all the advantages of man-made materials: sealing, resistance against rotting, inertness, shininess. A container of this kind may be implemented as a "boiling bag", which term designates containers capable of withstanding the action of boiling water in which they are immersed to reheat their contents.

As the bottom 6 of the compartment 3 is backed by the film 60, there is no need to use the central part of the frame 5*a* to reinforce it. This is shown here, however, to show that the central part 40 has to be placed between the two films 4 and 60 if a container entirely covered with man-made material on all sides is required.

Figure 14:
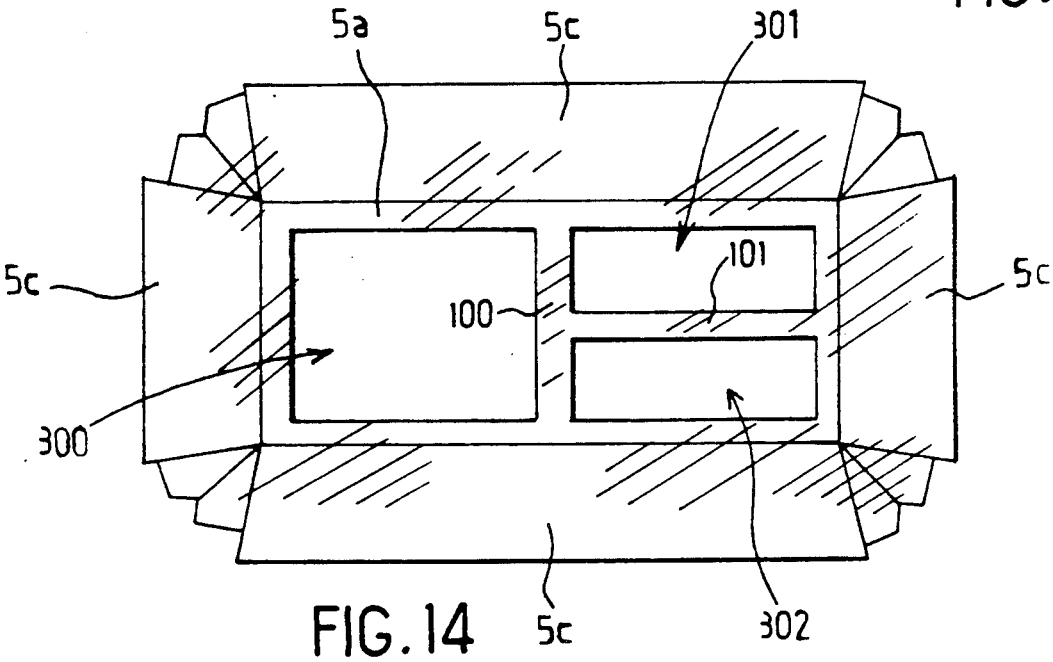
FIG. 14 is a plan view of a cut and scored cardboard blank in accordance with the invention for producing a container of the type shown in FIG. 15 after folding and heat-forming a film of man-made material.
Figure 15:
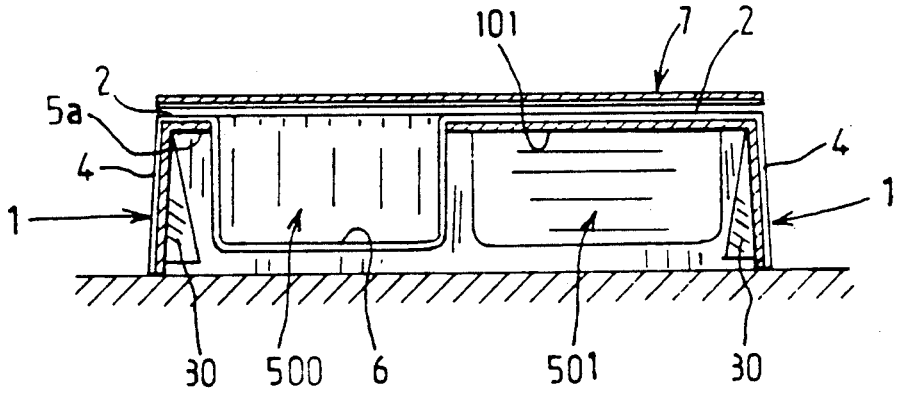
FIG. 15 is a schematic view in cross-section of a container in accordance with the invention and comprising an upper frame and several compartments covered by a single lid designed to be removed as a whole to uncover all compartments at once.

FIGS. 14 and 15 show an embodiment illustrating the possibility of applying the invention to producing multiple-compartment containers.

The blank of FIG. 14 still comprises a frame 5*a* and walls 5*b* joined by flaps designed to produce feet 30. However, the frame 5*a* has a branch 100 parallel to the smaller sides and joining the larger sides together with a branch 101 perpendicular to the branch 100 and joining the latter to one of the smaller sides. This produces an opening 300 and two smaller openings 301 and 302. The man-made material film 1 forms as many compartments as there are openings, three in this instance: 500, 501 and 502 (the compartment 502 is not visible as it lies outside the cross-section plane of FIG. 15). The three compartments are to receive respective products either to prevent them mixing or to protect them better. It is therefore possible to produce meal-trays to contain, for example, a salad, a sauce-based dish and a dessert. It is also possible to produce containers for selling diverse products or products to be mixed together at the time of use only. A single lid 7 closes off this container, being fixed not only to the frame 1 but also to the branches 100 and 101 to isolate the various compartments.

The lid 7 is designed to be removed as a whole to open the three compartments at the same time. The products placed in this container may constitute, for example, a food preparation with three essential ingredients to be mixed only at the last moment: a meat in sauce and two vegetables, fish, a sauce and a vegetable, and so on.

Using the same principle, meal-tray type containers may be produced with several compartments respectively containing an hors d'oeuvre, a cooked dish, a cheese, a dessert, eating utensils, condiments, etc.

The invention may obviously be used to produce containers intended for non-food products. A plurality of compartments may be desirable for articles to be sold in a number of parts to be assembled and combined with assembly members, etc.

Figure 16:
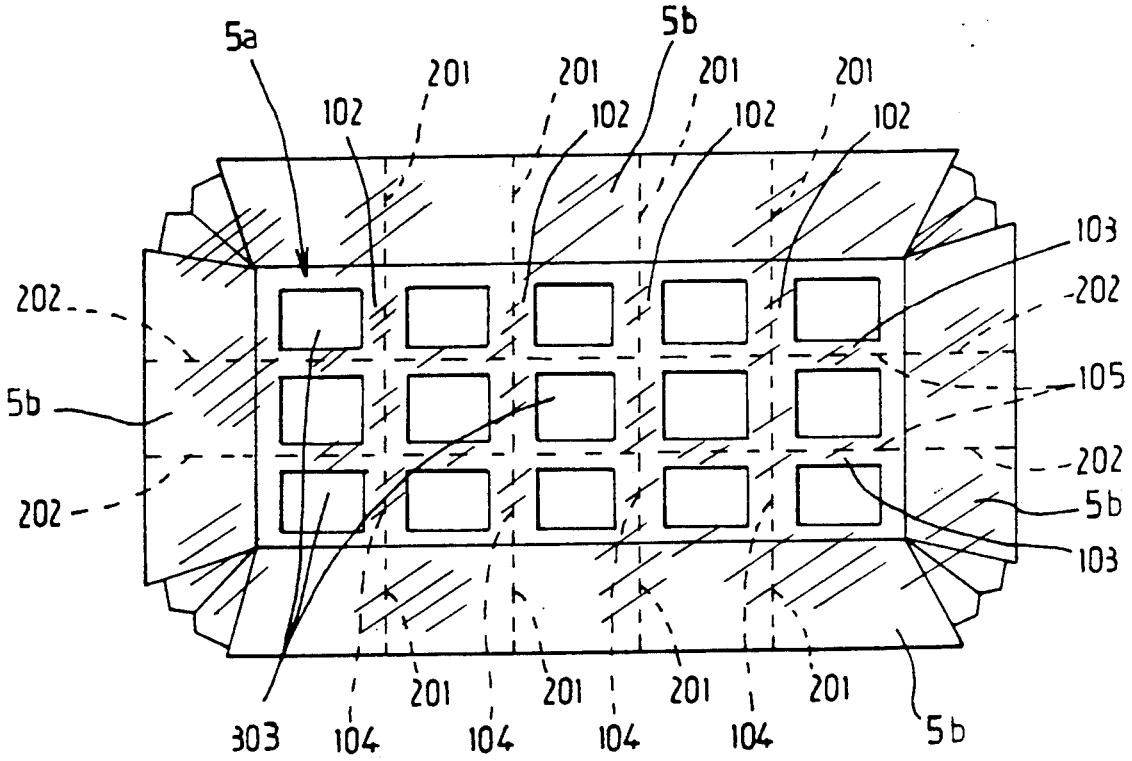
FIG. 16 is a plan view of a cut and scored cardboard blank in accordance with the invention for producing a container of the type shown in FIG. 17 after folding a heat-forming film of man-made material.
Figure 17A:
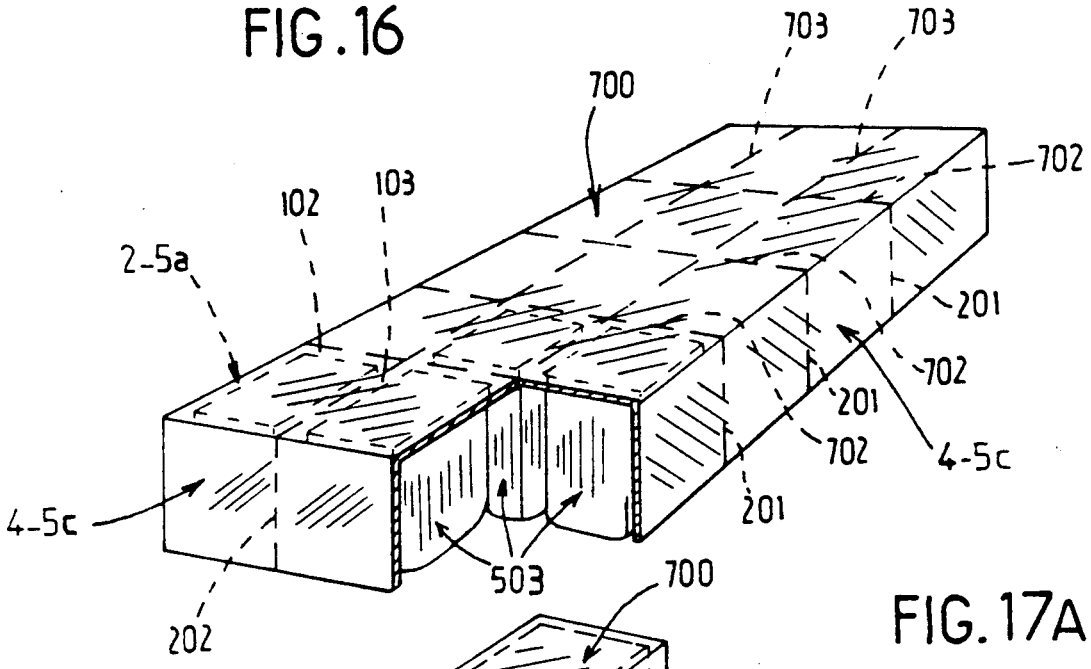
FIG. 17 is a schematic view in cross-section of a container in accordance with the invention and comprising several compartments covered by a single lid designed to be removed in sections, each on removing one compartment, the compartments being rendered individually separable by means of lines of weakness.
Figure 17B:
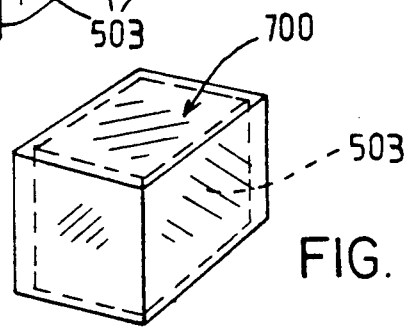

Referring now to FIG. 16 and 17, there is seen another embodiment of the invention in which the container still forms a unitary assembly with a top 2–5*a* featuring a plane frame in a single piece but in this instance the container is designed to be opened part by part rather than all at once.

The top 5*a* features a peripheral frame and branches 102 joining the inside longer edges of said frame and branches 103 joining the shorter edges, which defines four-sided openings 303 of equal size and regularly distributed. In the example shown here the container has 15 openings 303 designed to receive a man-made material film comprising the same number of sealed compartments 503.

The whole is closed by a single lid 701 fixed not only to the frame proper of the top 5*a* but also to the branches 102 and 103. Break lines 702 in line with the branches 102 and 103 make it possible to tear off the lid 701 part by part, above each compartment 503.

To empty the compartment 503 of its contents, provided that the product permits this the container as a whole may be turned over and the compartment 503 pressed, its walls deforming, in order to expel the product.

Provision may also be made for separating the compartments 503 and the individual cardboard parts associated with each of them, as shown in FIG. 17. To this end it is necessary to provide lines of weakness 104 in the cardboard in the middle of each branch 102 and lines of weakness 105 in the middle of each branch 103. Also, lines of weakness 201 on the larger walls 4–5*c* and lines of weakness 202 on the smaller walls 4–5*c* must be provided in alignment with the lines 104 and 105. The man-made material film constituting the compartments 503 may also be marked with lines of weakness. The lines of weakness in the cardboard part, in the man-made material film and even in the lid 700 may be formed simultaneously when the container is formed to shape, notably by creating lines of fine perforations sufficiently far away from the upper edges of the compartments 503 to preserve their individual sealing.

In practice various of the embodiments described and shown may be combined, of course: container with internal and external film (FIG. 13) and insulation (FIG. 2), stackable (FIG. 5) with reinforced bottom (FIG. 13) and multiple compartments (FIG. 15), to give just one example.

As is known in itself, the man-made material may be a simple or complex film, heat-formable or stampable. The cardboard and the man-made material may be bonded together using a hot or cold adhesive or by interlocking recesses and reliefs of any known kind.

The container may be four-sided, as is usually the case, but also circular or polygonal. Each opening in the top for forming a compartment may also have different cross-sections and lateral shapes. A single lid may be provided for several compartments. (sub-dividable or otherwise), or one lid may be provided for each compartment.

In accordance with the invention, to manufacture a container of the general type described above, the first step is to create a cardboard blank which is printed, scored and cut to feature a central area from which at least one opening is cut out.

Figure 9:
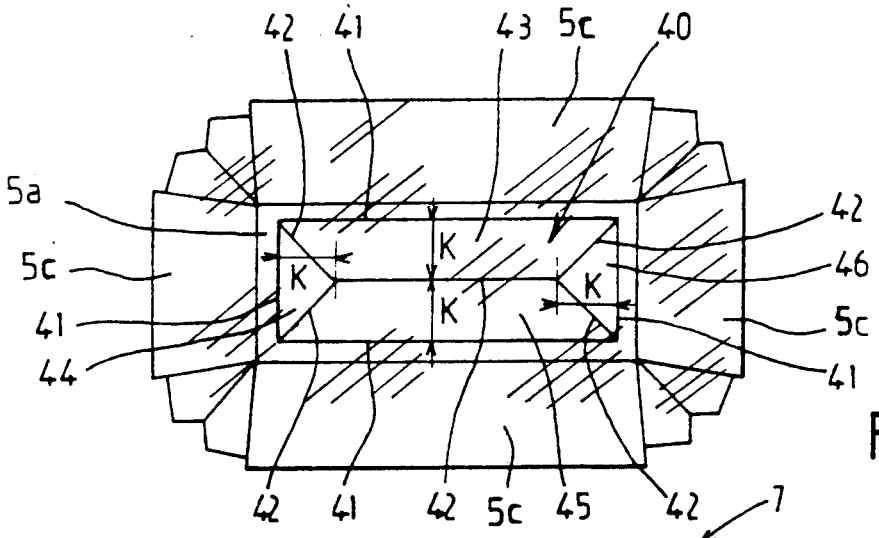
FIG. 9 is a plan view of a cut and scored blank in accordance with the invention for producing a container of the type shown in FIG. 10 after folding and heat-forming a film of man-made material.

The term "cut out" means that the central area can comprise one or more openings (FIGS. 1 through 8 and 11 through 17) from which the cardboard is removed, or simply cut through without removing the material, as is the case with FIGS. 9 and 10 in particular.

The printed side is that intended to receive the man-made material film, which must therefore be transparent.

The blanks produced in this way are stored for forming to shape at a later stage. This forming to shape to finish the container may be done where the blanks are printed or where the products are packaged. In the former case the containers are supplied in bulk, empty, nested one within another and, obviously, not closed. In the latter case the blanks are supplied flat to the manufacturer who assembles the containers immediately before filling and closing them.

The known method of heat-forming in a mold is employed for forming the containers to shape, which is equivalent to finishing them before filling them. The mold comprises one or more parts in relief corresponding to the hollow space of the container defined by the top and the side walls. Each blank is placed bell-fashion onto this relief so that the cardboard panels 5*c* of the walls are immobilized in their operative position, the top 5*a* being placed on the relief. The adjacent edges of the panels 5*c* are joined more or less intimately according to whether they are provided with joining flaps 35–36 or not. In any event, these edges are regarded as simply "adjacent" because they constitute a discontinuity in the cardboard part of the walls and are incompatible with even the slightest sealing effect, unless the facing surfaces of the flaps 35 and 36 are glued, which is not a particularly useful combination given that the cardboard itself is a hydrophilic material.

The relief part of the mold comprises on its upper surface as many cells as the container must have compartments and therefore the same number as there are openings provided in the top 5*a*. As has already been explained, there may be just one opening for a single cell or a small number of openings for a small number of cells (this is the case with FIGS. 14 and 15) or one or more series of openings for a plurality of cells (this is the case with FIGS. 16 and 17).

When the cardboard part 5 is formed to shape, a continuous film 1 of man-made material is heat-shaped and applied to the outside surfaces of the top 5*a* and of the side panels 5*c*. Due to the combined effect of temperature and pressure, it penetrates into the cells of the mold through the openings in the top 5*a*.

If these openings are associated with reinforcing flaps 43 through 46 (FIGS. 9 and 10) or 53 through 56 (FIGS. 11 and 12), then these flaps may either be folded towards their final position, in the same way as the wall panels are folded, or the thrust applied by the film 1 when it is heat-formed may be used to cause folding of these flaps. Those skilled in the art know how to perform this type of operation so that it is not necessary to describe it in detail. Suffice to say that the flaps must be defined by well-defined score lines, or even incised lines, so that they are easily folded without opposing excessive resistance. As for the film 1, it must be sufficiently strong and/or thick to exert a mechanical action on the flaps without tearing or adopting an inappropriate shape.

As is known, depending on whether the walls of the compartments 3 are required to be smooth on the inside or on the outside, recesses are respectively needed or not needed in the mold to accommodate the flaps. In the case of FIGS. 10 and 12, the compartments 3 have walls that are smooth on the inside, the additional thickness of cardboard of the flaps being on the outside. This presupposes that the mold comprises recesses for these flaps so that the film 1 encounters a continuous surface between that of the flap and that of the mold beyond the latter.

A cardboard part 40–51 (FIGS. 8 and 12) may be placed in each recess so that the film 1 adheres to it when it is heat-formed.

The shape and volume of the container are therefore defined, it is sealed and the required compartment or compartments are therefore all formed in a single heat-forming operation.

Finished containers ready for filling are therefore removed from the mold. Depending on the type of organization, provision may be made for intermediate storage, possible transportation and regular removal from stock, or the containers are fed from the mold to a packaging line where they are filled, fitted with lids, evacuated or filled with a controlled atmosphere, where applicable, heat treated, etc.

The filled, packaged and lidded containers are then grouped together for dispatch.

We claim:

1. A container comprising:

a synthetic material film shaped so as to define at least one sealed compartment, said at least one compartment being a hollow interior space with walls and a bottom surface coupled to the walls so as to allow said at least one compartment to be capable of containing material, a plane top around the at least one compartment, continuous external walls surrounding said at least one compartment, said synthetic material film thereby forming a double side wall where one wall is a wall of the compartment and a second wall is a part of the wall of the external walls, said at least one compartment having a height less than or equal to that of the external walls, the synthetic material film being backed by at least one bonded-on cardboard layer over substantially all of an inside surface of the external walls and a lower surface of the plane top, a second synthetic material film in a single piece which constitutes an uninterrupted outside wall covering the container and the plane top, wherein said cardboard layer comprises in a single piece a top having at least one opening therein and side walls with adjacent edges, and projections from an interior wall of the cardboard layer, the projections having bases that are slightly short of a lower edge of the external walls, a perimeter of the container at the level of the top being smaller than a perimeter of the container at a level of said lower edge of the external walls.

2. A container according to claim 1, further comprising a continuous peripheral rim situated in a plane parallel to that of the top and at the level of a lower edge of the external walls, a planar portion being adapted to be fixed to said rim below the at least one compartment.

3. A container according to claim 1, wherein the synthetic material film is of the flexible type adapted to shrink around its contents, below the top only, when a vacuum is created in a known manner inside the at least one compartment after the at least one compartment is filled.

4. A container according to claim 1, further comprising lines of weakness provided around the at least one compartment for enabling the at least one compartment to be separated from the container.

5. A container according to claim 1, wherein the plane top includes break lines for enabling the plane top to be torn off in pieces that cover the top opening of said at least one compartment.

6. A container according to claim 5, wherein the top of the cardboard layer has lines of weakness aligned with the break lines of the lid and the external walls have lines of weakness aligned with those of the top of the cardboard layer.

7. A container according to claim 1, further comprising a second synthetic material film applied to the inside of the external walls and under the top of the cardboard layer.

8. A container according to claim 1, wherein the top of the cardboard layer is joined to flaps folded towards an interior of at least one opening formed by the at least one compartment.

9. A container according to claim 8, wherein the flaps have oblique lateral edges resulting from cutting a central cardboard part out from each opening along lines running from an inside corner of each opening.

10. A container according to claim 8, wherein the folded flaps have a height substantially equal to half a shortest distance between the two opposite sides of each opening.

11. A container according to claim 8, wherein the flaps include a remainder of a central cardboard part of each opening after cutting out a central area.

12. A container according to claim 1, wherein openings cut out from the top of the cardboard layer define a central area disposed in a plane parallel to that of the top of the cardboard layer under the at least one compartment where it is fixed.

13. A container according to claim 7, wherein the second synthetic material film is applied to the inside of the external walls, under the top, outside the at least one compartment and optionally under a detached central area fixed to the at least one compartment.

14. A container according to claim 1, wherein the cardboard layer includes flaps which join the two adjacent edges of the walls and which are adapted to be folded against each other towards an inside of the container, substantially along a line bisecting an angle between the adjacent edges of the walls after folding, in order to form feet which are situated at corners of and inside the external walls.

15. A container according to claim 14, wherein the flaps are cut so that the projections have, after folding, a base which is slightly short of a lower edge of said external walls, a perimeter of the container at a level of the top of the cardboard layer being smaller than a perimeter of the container at a level of the lower edge of the external walls.

* * * * *